US006389626B1

(12) United States Patent
Hung

(10) Patent No.: US 6,389,626 B1
(45) Date of Patent: May 21, 2002

(54) TOOL STRUCTURE

(76) Inventor: Kun Chih Hung, No. 56, Hsin Jen 3rd Street, Ta-Li City, Taichung Hsien (TW)

( * ) Notice: Subject to any disclaimer, the term of this patent is extended or adjusted under 35 U.S.C. 154(b) by 0 days.

(21) Appl. No.: 09/694,335

(22) Filed: Oct. 24, 2000

(51) Int. Cl.[7] ..... B25B 7/22
(52) U.S. Cl. ..... 7/128; 81/305; 81/311
(58) Field of Search ..... 81/305, 311; 30/255; 7/128

(56) References Cited

U.S. PATENT DOCUMENTS

| | | | | | |
|---|---|---|---|---|---|
| 2,446,022 | A | * | 7/1948 | Peterson | 81/305 |
| 2,651,227 | A | * | 9/1953 | Kennington | 81/305 |
| 4,316,315 | A | * | 2/1982 | Vogelnik | 81/305 X |
| 6,023,805 | A | * | 2/2000 | Lin | 7/128 |
| 6,223,374 | B1 | * | 5/2001 | Lin | 7/128 X |

FOREIGN PATENT DOCUMENTS

| | | | | |
|---|---|---|---|---|
| FR | 1378669 | * | 10/1964 | 81/311 |
| GB | 2223 | * | 7/1888 | 81/305 |
| GB | 658069 | * | 10/1951 | 81/305 |

* cited by examiner

*Primary Examiner*—James G. Smith
(74) *Attorney, Agent, or Firm*—Rosenberg, Klein & Lee

(57) ABSTRACT

A Tool structure including a tool assembly and two grips. The tool assembly is formed by a first, a second, a third and a fourth arms which are pivotally connected with each other to form a mechanism as a four-link mechanism. The first and second arms and the third and fourth arms respectively form two kinds of tools. Two ends of the grips are respectively pivotally connected with the pivot sections of the first and third connecting sections and the pivot sections of the second and fourth connecting sections. Therefore, when the grips are held and closed to make the tools formed by the first and second arms and the third and fourth arms get close to each other and close, the two grips are not coaxially pivotally rotatable with the first and second arms and the third and fourth arms. Accordingly, the maximum opening extent of the two grips can be reduced for easy holding.

5 Claims, 8 Drawing Sheets

TOOL STRUCTURE

BACKGROUND OF THE INVENTION

The present invention relates to an improved tool structure which can be easily held and forced and can be easily carried and stored.

FIG. 8 shows a conventional tool including two symmetrical arm members 81, 82 pivotally connected with each other. Two ends of the pivot sections of the two arm members 81, 82 are respectively formed with a point nosed pliers 83 and a flat-head pliers 84. Two grips 85, 86 are pivotally disposed at the pivot sections of the two arm members 81, 82.

In use of the flat-head pliers 84, the two grips 85, 86 are pivotally rotated toward the point nosed pliers 83 and leant on the outer side of the point nosed pliers 83. When a user tightly holds the two grips 85, 86 to pivotally rotate the same about the pivot sections of the arm members 81, 82, the point nosed pliers 83 is pressed to drive the flat-head pliers 84 for clamping a work piece.

It is known that when a human palm is in a state of slightly opened fist, the palm can create a maximum holding force. In the case that the palm is excessively opened, it will be hard for the palm to apply a necessary-force onto the tool. According to the above conventional tool, the two grips 85, 86 are pivotally disposed at the pivot sections of the two arm members 81, 82. Therefore, the two grips 85, 86 are opened to an extent substantially equal to that of the two arm members 81, 82. Accordingly, in working, the pliers is necessary to be opened to a certain extent. Under such circumstance, in normal state, the two grips 85, 86 will be opened to a greater extent. Therefore, a user must open his palm to a very great extent for holding the two grips 85, 86. Under such circumstance, it is hard for the user to apply a force onto the tool.

Moreover, referring to FIG. 9, the opening extent of the two grips 85, 86 is limited by the opening extent of the two arm members 81, 82. Therefore, after the two arms 81, 82 are mated with each other, the two grips 85, 86 are still opened to a certain extent. Therefore, a considerable room is necessary for storing the tool.

SUMMARY OF THE INVENTION

It is therefore a primary object of the present invention to provide an improved tool structure including a tool assembly and two grips. The tool assembly is formed by a first, a second, a third and a fourth arms which are pivotally connected with each other to form a mechanism as a four-link mechanism. Two ends of the grips are respectively pivotally connected with the pivot sections of the first and third connecting sections and the pivot sections of the second and fourth connecting sections. Therefore, when the grips are held and closed to make the tools formed by the first and second arms and the third and fourth arms get close to each other and close, the two grips are not coaxially pivotally rotatable with the first and second arms and the third and fourth arms. Accordingly, the maximum opening extent of the two grips can be reduced for easy holding and forcing.

It is a further object of the present invention to provide the above tool structure in which when the tool assembly is closed, the two grips also get close to each other and are closed. Therefore, the volume of the tool is reduced for easy carriage and storage.

The present invention can be best understood through the following description and accompanying drawings wherein:

Figure 1:
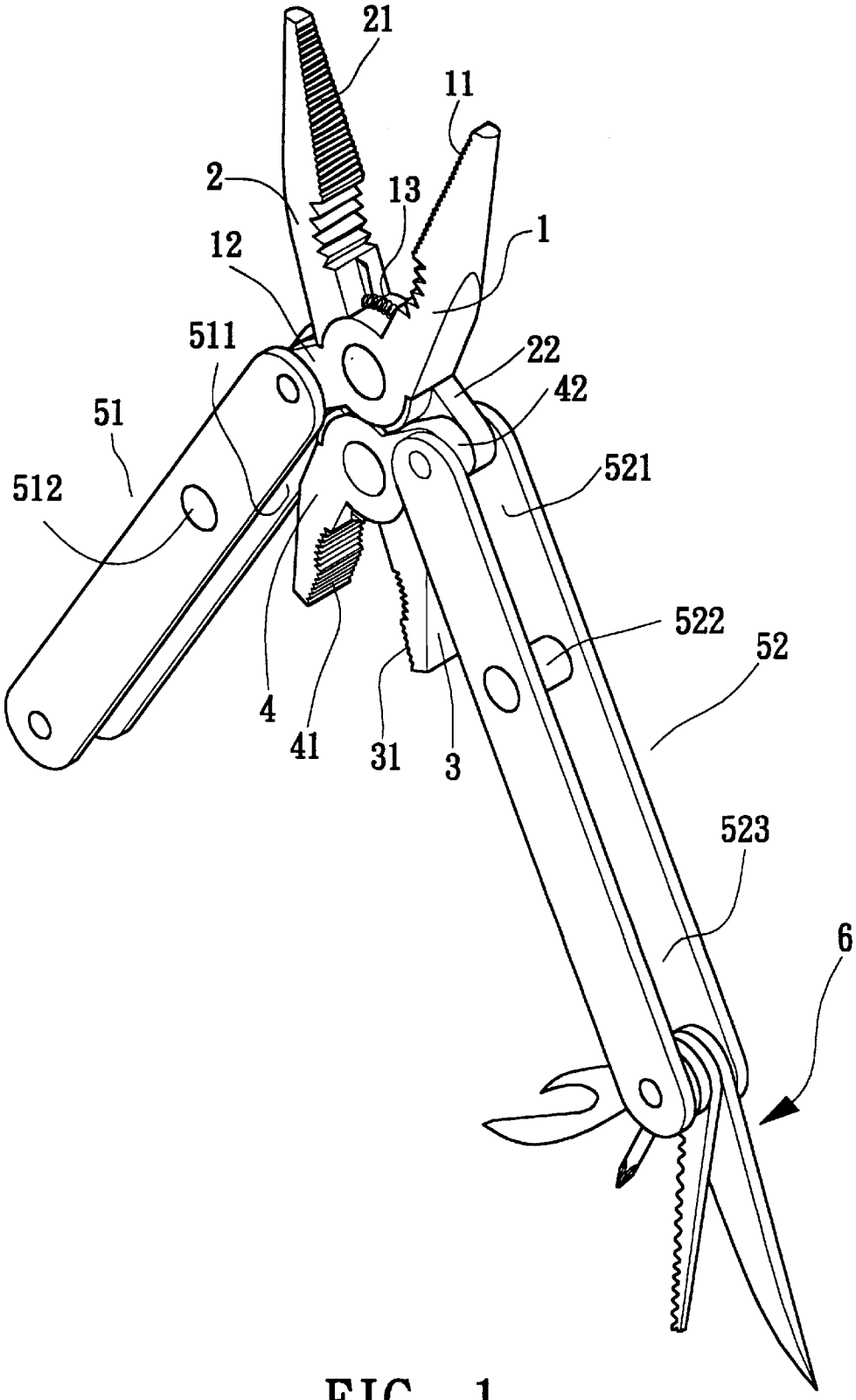
FIG. 1 is a perspective assembled view of a first embodiment of the present invention.
Figure 2:
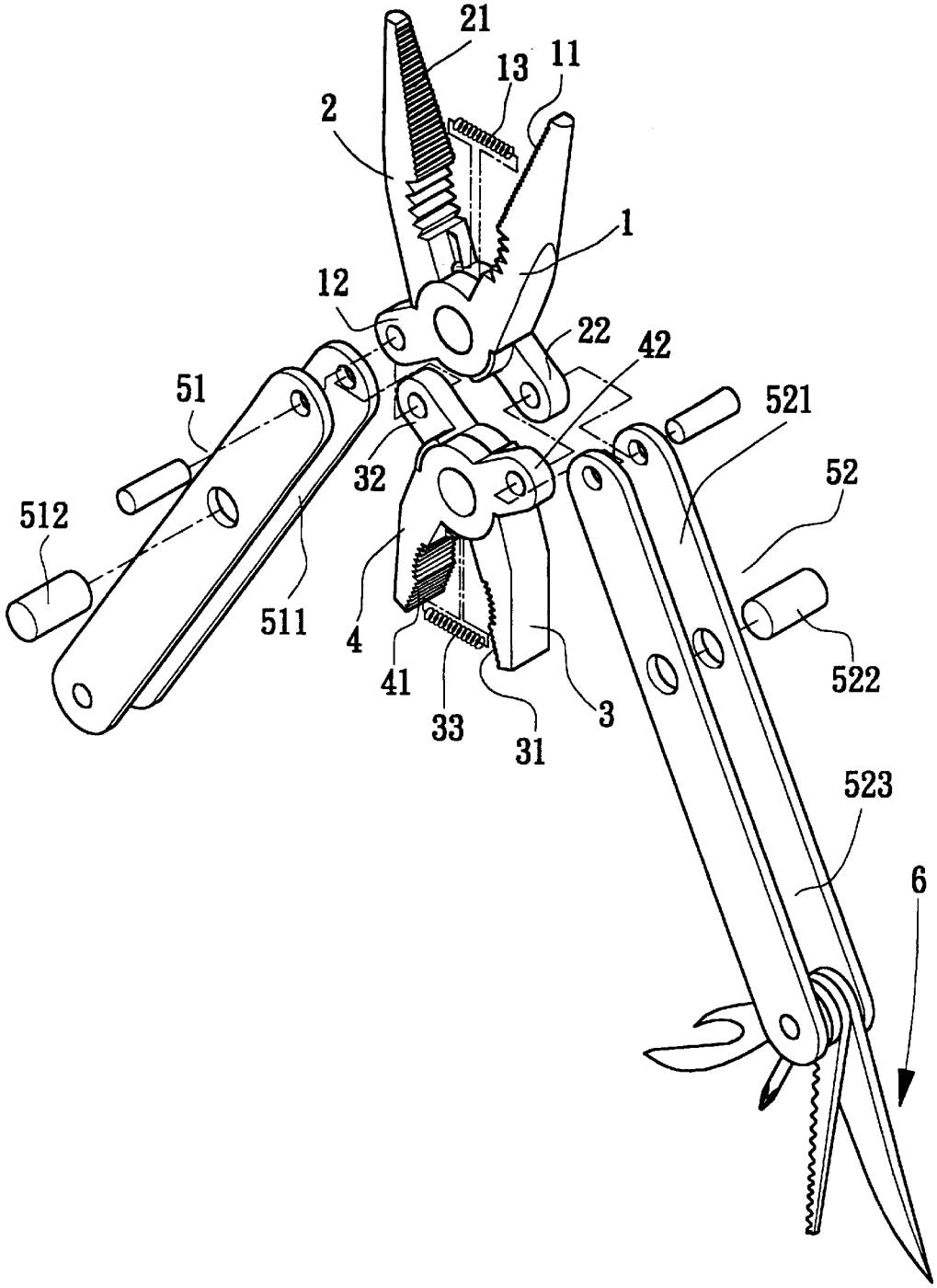
FIG. 2 is a perspective exploded view of the first embodiment of the present invention.

Fig . 9 is a plane view showing the conventional tool in a closed state.

DETAILED DESCRIPTION OF THE PREFERRED EMBODIMENTS

Please refer to FIGS. 1 to 5. The tool structure of the present invention includes:

a tool assembly formed by a first arm 1, a second arm 2, a third arm 3 and a fourth arm 4 pivotally connected with each other, the first and second arms 1, 2 being pivotally connected with each other and intersecting each other, two ends of the pivot sections of the first and second arms 1, 2 being respectively formed with a first and a second working sections 11, 21 and a first and a second connecting sections 12, 22, in this embodiment, the first and second working sections 11, 21 being formed with a pattern of point nosed pliers, the third and fourth arms 3, 4 being pivotally connected with each other and intersecting each other, two ends of the pivot sections of the third and fourth arms 3, 4 being respectively formed with a third and a fourth working sections 31, 41 and a third and a fourth connecting sections 32, 42, in this embodiment, the third and fourth working sections 31, 41 being formed with a pattern of flat-head pliers, after the first and third connecting sections 12, 31 are pivotally connected, the second and the fourth connecting sections 22, 42 being pivotally connected, the first and second working sections 11, 21 and the third and fourth working sections 31, 41 being directed in reverse directions, two compression springs 13, 33 being respectively disposed between the first and second arms 1, 2 and the third and fourth arms 3, 4 for outward pushing and opening the first and second working sections 11, 12 or the third and fourth working sections 31, 41 in normal state; and two grips 51, 52, two ends of the grips 51, 52 being respectively pivotally connected with the pivot sections of the first and third connecting sections 12, 32 and the pivot sections of the second and fourth connecting sections 22, 42, each of the grips 51, 52 being formed with a receptacle 511, 521 near the pivot section for receiving the first, second, third and fourth working sections 12, 22, 32, 42, one end of the receptacle 511, 521 of each of the grips 51, 52 distal from the pivot section being disposed with a leaning section on which the first, second, third and fourth working sections 12, 22, 32, 42 of the tool assembly can be leant, in this embodiment, the leaning section being a beam member 512, 522, one end of the grip 52 distal from the pivot section being pivotally disposed with a multi-use tool kit 6, the end of the grip 52 being formed with a second receptacle 523 in which the multi-use tool kit 6 can be pivotally turned and received.

Figure 3:
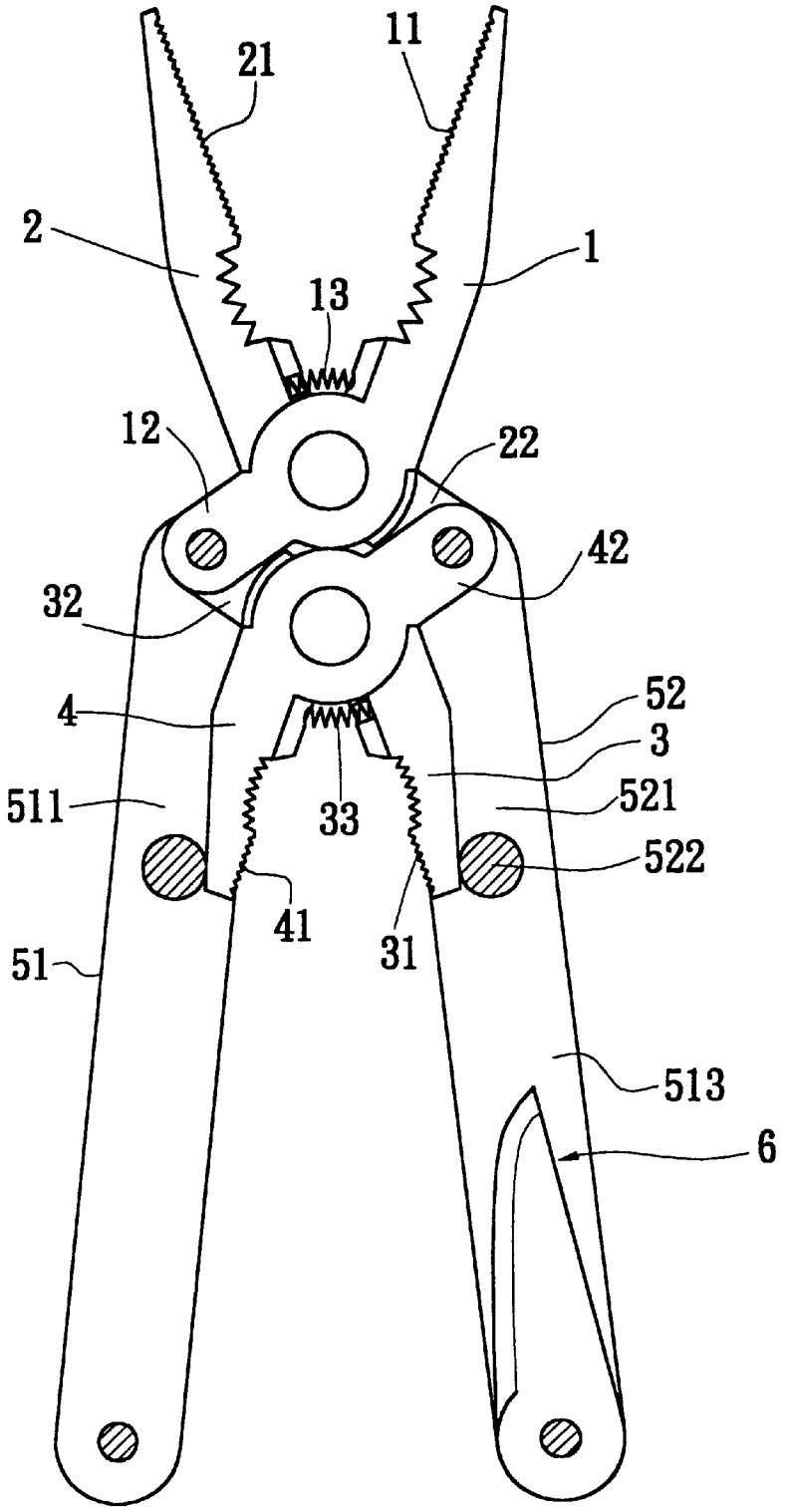
FIG. 3 is a plane view of the first embodiment of the present invention.
Figure 4:
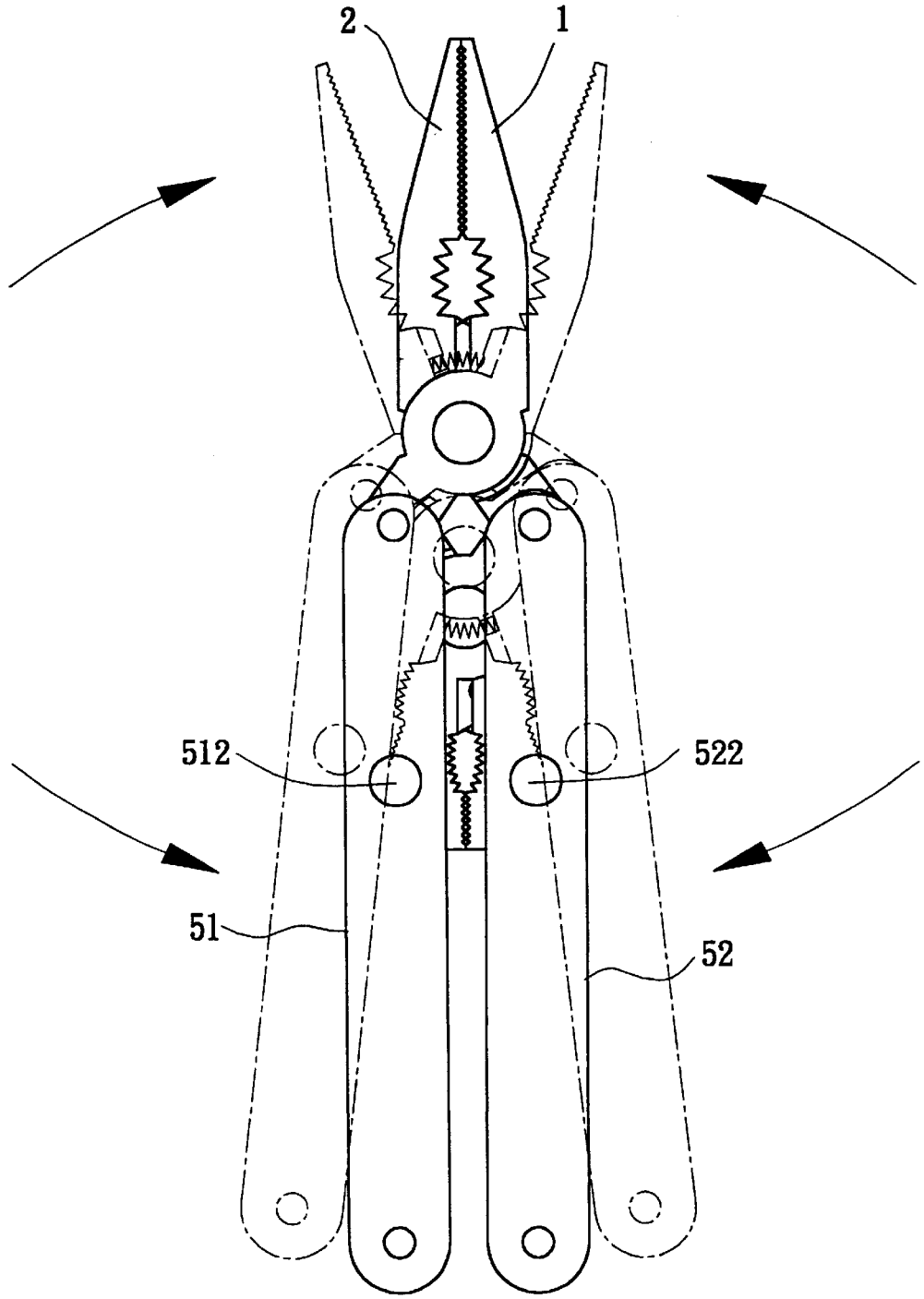
FIG. 4 shows the operation of the first embodiment of the present invention.
Figure 5:
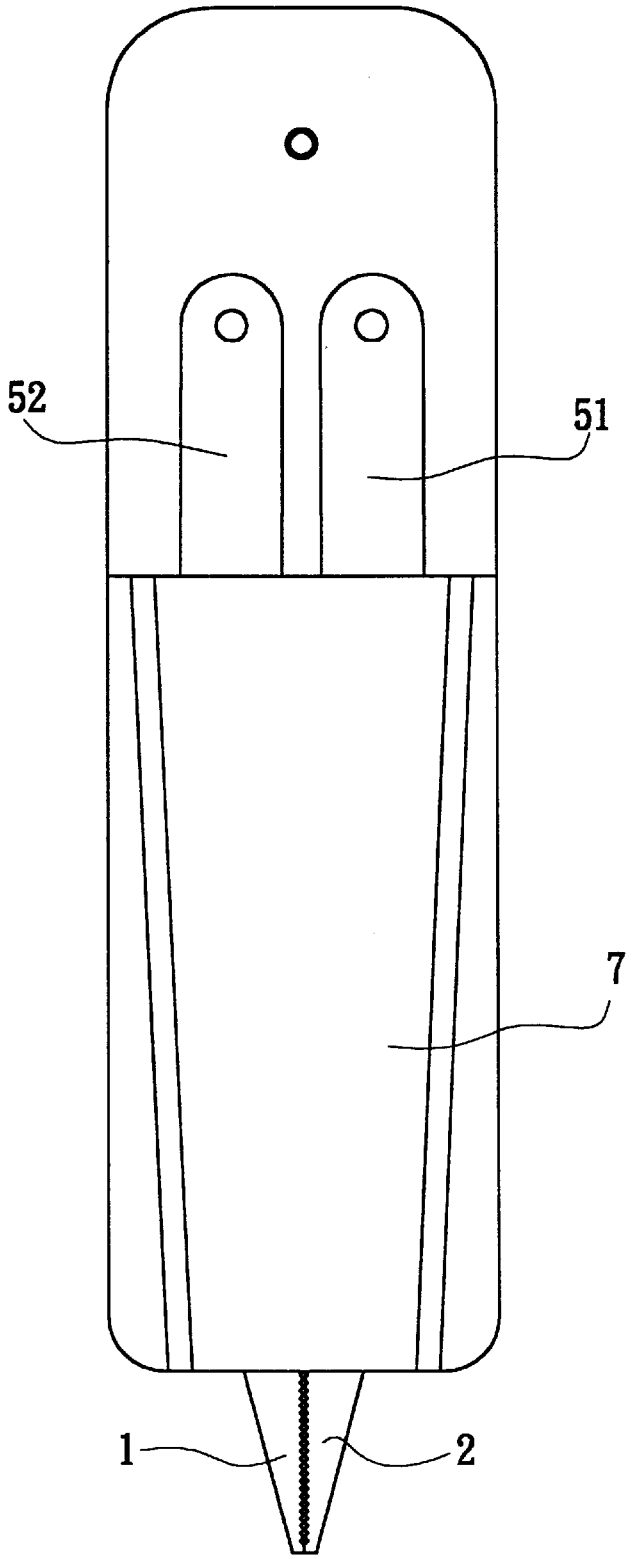
FIG. 5 shows that the first embodiment of the present invention is closed and received in a protective sheath.
Figure 6:
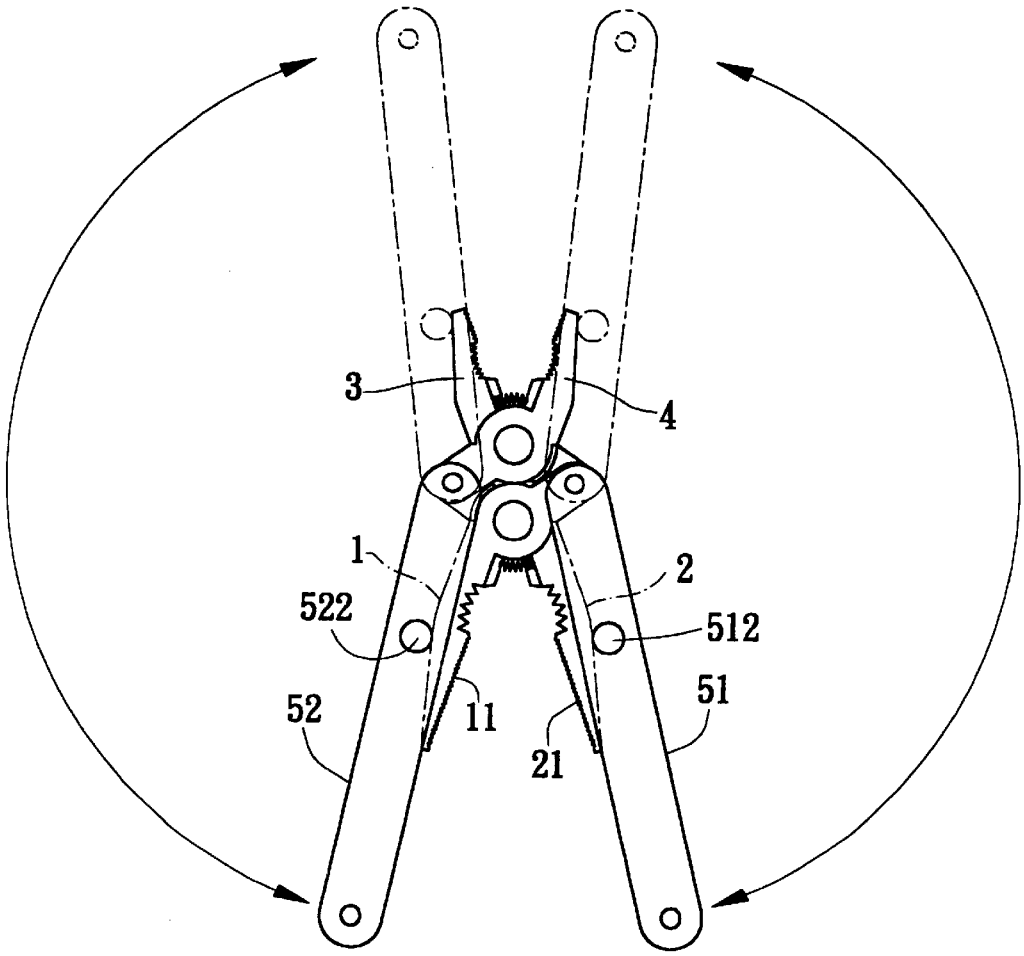
FIG. 6 shows the pivotal rotation of the two grips of the first embodiment of the present invention.

Please refer to FIG. 3. The first, second, third and fourth working sections 12, 22, 32, 42 are resiliently outward pushed and opened by the springs 13, 33 in normal state. When it is needed to use the point nosed pliers formed by the first and second working sections 11, 12, the two grips 51, 52 are pivotally rotated to one end of the third and fourth arms 3, 4. At this time, the beam members 512, 522 of the leaning sections of the two grips 51, 52 are respectively leant against the outer sides of the third and fourth working sections 32, 42. The third and fourth arms 3, 4 are partially received in the receptacles 511, 521. The first, second, third and fourth arms 1, 2, 3, 4 are pivotally connected with each other to form a mechanism as a four-link mechanism two ends of the grips 51, 52 being respectively pivotally connected with the pivot sections of the first and third connecting sections 12, 32 and the pivot sections of the second and fourth connecting sections 22, 42. Therefore, the two grips 51, 52 are not coaxially pivotally rotatable with the first and second arms 1, 2 and the third and fourth arms 3, 4. Accordingly, when the first and second working sections 11, 21 are outward opened to a certain extent, the two grips 51, 52 will not be over-opened so that a user can easily hold the tool. Referring to FIG. 4, when the user holds and applies a force onto the two grips 51, 52, the application force is inward directed to simultaneously press the pivot sections of the first and third connecting sections 12, 32 and the pivot sections of the second and fourth connecting sections 22, 42. Also, the beam members 512, 522 of the two grips 51, 52 will press the outer sides of the fourth and third working sections 42, 32, making the first and second working sections 11, 21 mate with each other for clamping a work piece. When the two grips 51, 52 are mated with each other, they are moved toward each other rather than coaxially rotated as the grips and pliers of the conventional tool. Therefore, the user's palm can easily hold and apply a force onto the grips which are opened to a suitable extent. Further referring to FIG. 5, after used, the tool can be received in a protective sheath 7. When the first and second working sections 11, 21 are mated with each other, the two grips 51, 52 also get close to and mate with each other. Therefore, after closed, the tool has smaller volume for easy carriage. When using the flat-head pliers formed by the third and fourth working sections 32, 42, the two grips 51, 52 are pivotally rotated to one side of the first and second arms 1, 2 as shown in FIG. 6.

According to the above arrangement, the first, second, third and fourth arms 1, 2, 3, 4 are pivotally connected with each other to form a mechanism as a four-link mechanism two ends of the grips 51, 52 being respectively pivotally connected with the pivot sections of the first and third connecting sections 12, 32 and the pivot sections of the second and fourth connecting sections 22, 42. Therefore, the two grips 51, 52 are not coaxially pivotally rotatable with the first and second arms 1, 2 and the third and fourth arms 3, 4. Accordingly, the maximum opening extent of the two grips 51, 52 is reduced for easy holding. In addition, when the tool assembly is closed, the two grips 51, 52 also get close to each other and are closed. Therefore, the volume of the tool is reduced for easy carriage and storage.

Figure 7:
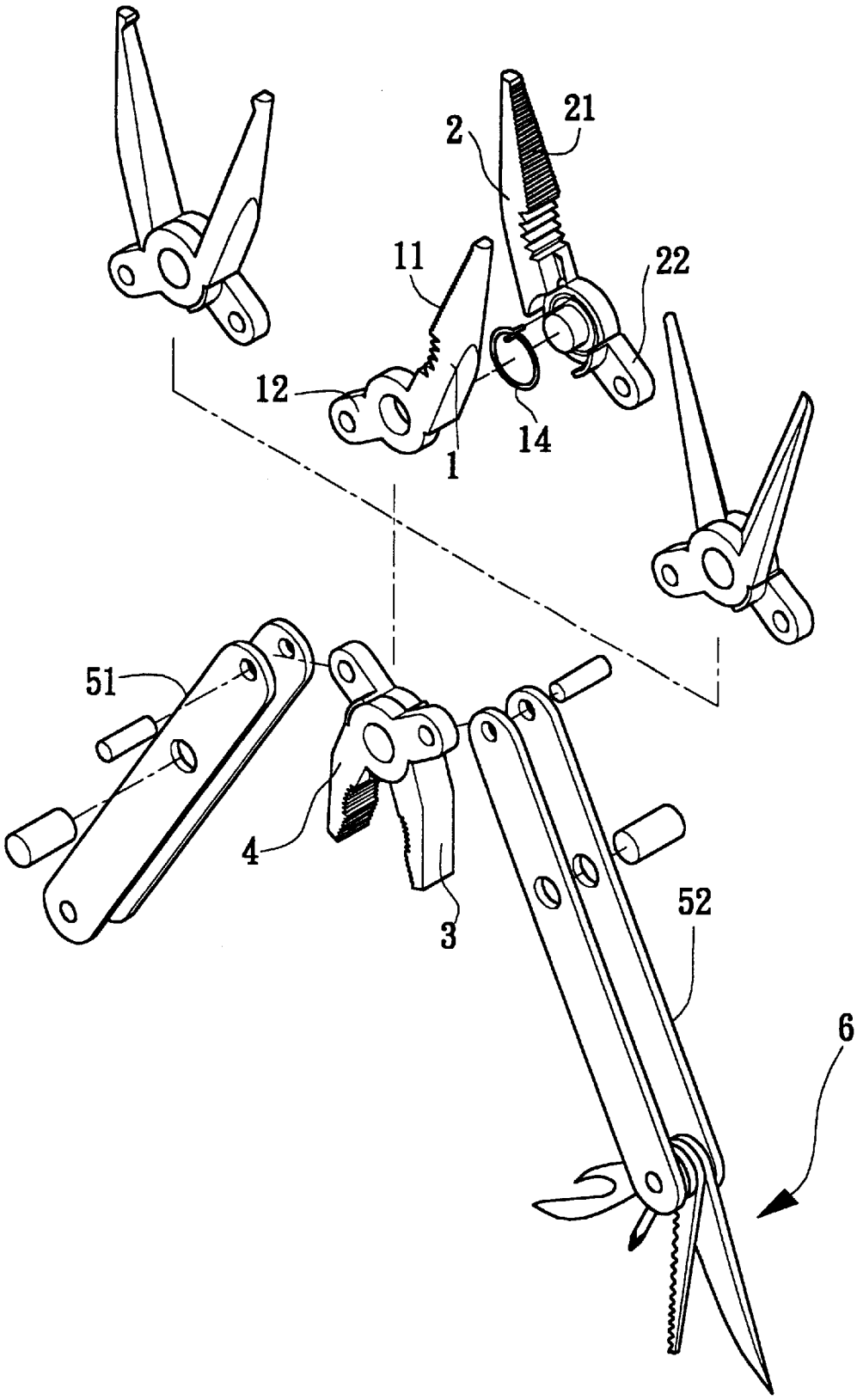
FIG. 7 is a perspective exploded view of a second embodiment of the present invention.
Figure 8:
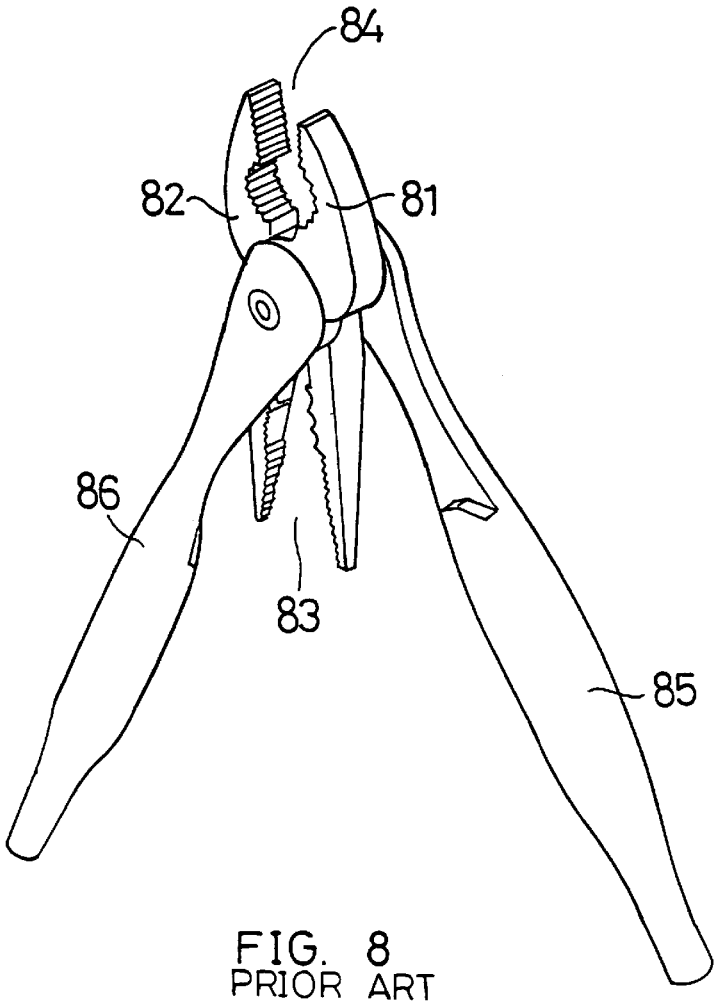
FIG. 8 PRIOR ART
FIG. 8 is a perspective assembled view of a conventional tool.
Figure 9:
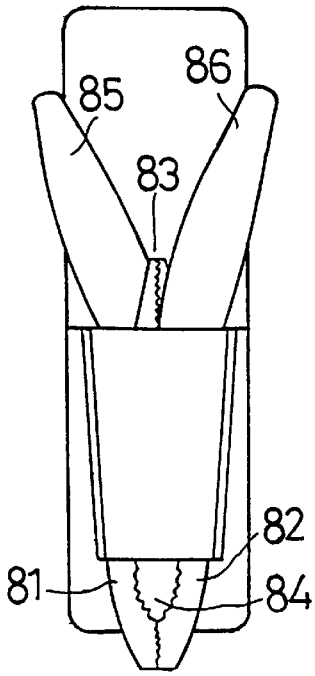
FIG. 9 PRIOR ART

FIG. 7 shows a second embodiment of the present invention, in which the first and second working sections 11, 12 of the first and second arms 1, 2 are formed with a pattern of any of a pliers, a clip and a scissors. Only a torque spring 14 is disposed at the pivot section of the first and second arms 1, 2 for outward pushing and opening the first and second working sections 11, 12 and the third and fourth working sections 31, 41. Accordingly, the second embodiment can achieve the same function as the first embodiment.

The above embodiments are only used to illustrate the present invention, not intended to limit the scope thereof. Many modifications of the above embodiments can be made without departing from the spirit of the present invention.

What is claimed is:

1. A tool structure comprising:

a tool assembly formed by a first arm, a second arm, a third arm and a fourth arm and a fourth arm pivotally connected with each other, the first and second arms being pivotally connected with each other and intersecting each other, the first and second arms each having a pivot section, opposing ends of the pivot sections being respectively formed with a first and a second working section on one end and a first and a second connecting section on the other end, the third and fourth arms being pivotally connected with each other and intersecting each other, the third and fourth arms each having a pivot section, opposing ends of the pivot sections of the third and fourth arms being respectively formed with a third and a fourth working section on one end and a third and a fourth connecting section on the other end, the first and third connecting sections being pivotally connected, the second and the fourth connecting sections being pivotally connected, the first and second working sections and the third and fourth working sections being directed in reverse directions, at least one resilient member being disposed between the first and second arms or the third and fourth arms for outward pushing and opening of the first and second working sections or the third and fourth working sections in a normal state; and two grips, two ends of the grips being respectively pivotally connected with the pivot sections of the first and third connecting sections of the second and fourth connecting sections, each of the grips being formed with a receptacle near the pivot section, one end of the receptacle of each of the grips distal from the pivot sections being disposed with a leaning section against which the tool assembly can be leaned.

2. A Tool structure as claimed in claim 1, wherein the first and second working sections of the first and second arms are formed with a pattern of any of a pliers, a clip and a scissors.

3. A Tool structure as claimed in claim 1, wherein the third and fourth working sections of the first and second arms are formed with a pattern of any of a pliers, a clip and a scissors.

4. A Tool structure as claimed in claim 1, further comprising a multi-use tool kit pivotally disposed at one end of any of the grips distal from the pivot section, the end of the grip being formed with a second receptacle for receiving the multi-use tool.

5. A Tool structure as claimed in claim 1, wherein the leaning section of the grip is a beam member fixed on the grip.

* * * * *